US009511246B2

(12) United States Patent
Cordani

(10) Patent No.: US 9,511,246 B2
(45) Date of Patent: Dec. 6, 2016

(54) METHOD AND APPARATUS FOR TREATING UNDERGROUND CONDUITS

(71) Applicant: GelTech Solutions, Inc., Jupiter, FL (US)

(72) Inventor: Peter Cordani, Palm Beach Gardens, FL (US)

(73) Assignee: GelTech Solutions, Inc., Jupiter, FL (US)

( * ) Notice: Subject to any disclaimer, the term of this patent is extended or adjusted under 35 U.S.C. 154(b) by 0 days.

(21) Appl. No.: 14/755,338

(22) Filed: Jun. 30, 2015

(65) Prior Publication Data

US 2016/0023026 A1 Jan. 28, 2016

Related U.S. Application Data

(60) Provisional application No. 62/018,894, filed on Jun. 30, 2014.

(51) Int. Cl.

| | |
|---|---|
| ***A62C 2/00*** | (2006.01) |
| ***A62C 3/16*** | (2006.01) |
| ***A62C 5/00*** | (2006.01) |

(52) U.S. Cl.

CPC .. *A62C 3/16* (2013.01); *A62C 5/00* (2013.01)

(58) Field of Classification Search

CPC ..... A62C 3/08; A62C 31/28; A62C 35/68; A62C 37/36; B05B 3/044; B05B 3/14; B05B 3/16; B05B 7/08

USPC ..... 169/43, 45, 46, 52

See application file for complete search history.

(56) References Cited

U.S. PATENT DOCUMENTS

| | | | | |
|---|---|---|---|---|
| 4,978,460 | A | 12/1990 | Von Blucher et al. | |
| 5,087,513 | A | 2/1992 | Kim | |
| 5,190,110 | A | 3/1993 | Von Blucher et al. | |
| 5,519,088 | A | 5/1996 | Itoh et al. | |
| 5,849,210 | A | 12/1998 | Pascente et al. | |
| 5,909,777 | A * | 6/1999 | Jamison | A62C 3/0264 169/43 |
| 5,989,446 | A | 11/1999 | Hicks et al. | |
| 6,632,475 | B1 * | 10/2003 | Bleggi | B05B 3/027 118/302 |
| 6,834,728 | B2 | 12/2004 | Demole | |
| 7,096,965 | B2 | 8/2006 | Ozment | |
| 7,104,336 | B2 | 9/2006 | Ozment | |
| 7,124,834 | B2 | 10/2006 | Sundholm et al. | |
| 2013/0180738 | A1 * | 7/2013 | Kim | A62D 1/0064 169/45 |

* cited by examiner

*Primary Examiner* — Davis Hwu

(74) *Attorney, Agent, or Firm* — McHale & Slavin, P.A.

(57) ABSTRACT

An apparatus and method for extinguishing and/or suppressing an electrical fire within a wooden conduit. The apparatus includes a source of pressurized fire suppressant coupled to fluid dispenser by a flexible hose. The fluid dispenser includes a coupling element securable to the flexible hose and a body element formed from a tubular wall with a plurality of fluid passage apertures for distribution of the fire suppressant. A leading element of the fluid dispenser is available for securement to a draw line for pulling the fluid dispenser through the conduit. Further disclosed is the method for extinguishing and/or suppressing the electrical fire which includes mixing of a non-conductive fire suppressant fluid, and distributing the fluid throughout the wooden conduit by drawing the fluid dispenser through the conduit with either a fish line or a discarded electrical wire.

17 Claims, 6 Drawing Sheets

METHOD AND APPARATUS FOR TREATING UNDERGROUND CONDUITS

CROSS REFERENCE TO RELATED APPLICATIONS

In accordance with 37 C.F.R. 1.76, a claim of priority is included in an Application Data Sheet filed concurrently herewith. Accordingly, the present invention claims priority to U.S. Provisional Patent Application No. 62/018,894, filed Jun. 30, 2014, the contents of which the above referenced application is incorporated herein by reference.

FIELD OF THE INVENTION

This invention relates to the field of fire prevention, and more particularly to a method and apparatus for treating underground conduit for dispersion of a fire suppressant.

BACKGROUND OF THE INVENTION

In many cities the utilities are located beneath the surface of the earth, usually beneath the surface of the streets. These utilities are placed in tunnels or conduits. In older cities, such as New York City, these utilities have been located in these conduits for decades some of which dating back to the late 1800's. Earlier conduits were constructed of wood which are susceptible to decay. Over time, the conduits which carry these utilities may catch fire due to heat from electrical transmission lines. When the fire suppressant is used to suppress a fire in conduits made from wood, the use of a rodent repellant such as cayenne pepper can be included. Rodents remain adverse to peppers and the saturating of the conduit with pepper leaves a natural rodent repellant that will last for years.

While it is desirable to replace very old utilities in conduits and tunnels, it is not always practical. Due to financial restraints and other limitations, most of these electrical conduits and transmission lines have not been replaced, yet higher electrical demands are placed on the system. Unfortunately, failure of older electrical transmission lines can result in an electrical fire. These fires are commonly discovered when smoke is seen arising from manhole covers in the streets and sidewalks. It has been estimated by Consolidated Edison that there are approximately 40 electrical fires per day under the streets of New York City.

The cost of repairing and replacing the electrical transmission lines damaged by these fires is approximately $100,000.00 per linear foot of transmission line. Therefore, it is imperative that these fires be extinguished as quickly as possible. Inspection of electrical lines can help pinpoint potential trouble areas. A number of prior art references are directed to the extinguishing of fires including underground fires.

U.S. Pat. No. 6,834,728 discloses a system for extinguishing a fire in a tunnel. The system includes a conduit for delivering a fire extinguishing liquid and a trough extending parallel to the conduit for receiving liquid from the conduit. A carriage is arranged to move on a track which includes an upper edge of the trough. The carriage carries a pump having a nozzle, a video camera, and an inlet; each of which can be controlled robotically from a remote control station. The inlet is deployed in the trough to draw liquid from the trough.

U.S. Pat. No. 7,096,965 discloses a method of proportioning a foam concentrate into a non-flammable liquid to form a foam concentrate/liquid mixture and create a flowing stream of the foam concentrate/liquid mixture. The apparatus of this invention is adapted for expanding and dispensing foam and includes a housing defining an interior through which extends a discharge line. The ends of the housing are closed about the ends of the discharge line, and the ends of the discharge line extend beyond the ends of the housing to define a connector at one end for receiving a stream of foam concentrate/liquid and at the opposite end to define the foam dispensing end of the apparatus.

U.S. Pat. No. 7,104,336 discloses a method and apparatus for proportioning a foam concentrate into a non-flammable liquid to form a foam concentrate/liquid mixture and create a flowing stream of the foam concentrate/liquid mixture similar to the method and apparatus of U.S. Pat. No. 7,096,965.

U.S. Pat. No. 7,124,834 discloses a method for extinguishing a fire in a space such as a tunnel. The method includes spraying a fire extinguishing medium into the space by spray heads. In a first stage of the method, the flow and temperature of the hot gases produced by the fire are influenced by spraying an extinguishing medium into the space, especially by creating in the space at least one curtain of extinguishing medium. At least some spray heads in the space are pre-activated into a state of readiness. In a second stage of the method, at least one spraying head is activated to produce a spray of extinguishing medium.

U.S. Pat. No. 5,989,446 discloses a water additive for use in fire extinguishing and prevention. The additive comprises a cross-linked water-swellable polymer in a water/oil emulsion. The polymer particles are dispersed in an oil emulsion wherein the polymer particles are contained within discrete water "droplets" within the oil. With the help of an emulsifier, the water "droplets" are dispersed relatively evenly throughout the water/oil emulsion. This allows the additive to be introduced to the water supply in a liquid form, such that it can be easily educted with standard firefighting equipment.

U.S. Pat. No. 5,190,110 discloses the fighting of fires or protection of objects from fire by applying water which comprises dispersing in the water particles of a cross-linked, water-insoluble, but highly water-swellable, acrylic acid derivative polymer in an amount insufficient to bring the viscosity above 100 mPa's. Advantageously, the particles are present in an amount such that, after swelling, the swollen particles hold 60 to 70% by weight of the total water; the polymer being a copolymer of an acrylic acid, the water containing silicic acid and/or a silicate as well as sodium, potassium or ammonium ions. The water is freely pumpable, but the swollen particles adhere to surfaces they contact rather than running off rapidly.

U.S. Pat. No. 5,849,210 discloses a method of preventing or retarding a combustible object from burning including the steps of mixing water with a super absorbent polymer ("SAP") to form one at least partially hydrated SAP, and applying the partially hydrated SAP to the combustible object, before or after combustion. In another embodiment, an article of manufacture includes a SAP that is prehydrated and is useful for preventing a combustible object from burning, or preventing penetration of extreme heat or fire to a firefighter or other animal.

U.S. Pat. No. 5,087,513 discloses polybenzimidazole polymer/superabsorbent polymer particles. These articles are prepared by either mixing the super absorbent polymer particulates with the polybenzimidazole polymer solution during the formation of the polybenzimidazole article, or forming a composite of a polybenzimidazole film or fiber material layer with a super absorbent polymer particulate containing layer. These polybenzimidazole products absorb large amounts of fluid while retaining the flame retardancy and chemical unreactivity of conventional polybenzimidazole materials.

U.S. Pat. No. 4,978,460 discloses a particulate additive for water for firefighting containing a strongly swelling water-insoluble high molecular weight polymer as gelatinizing agent, which comprises a water-soluble release agent which causes the particles of said gelatinizing agent not to swell, the particles of the gelatinizing agent being encased or dispersed in the release agent. Suitable release agents include polyethylene glycol, sugars, mannitol, etc. The gelatinizing agent may be a moderately cross-linked water-insoluble acrylic or methacrylic acid copolymer.

U.S. Pat. No. 5,519,088 discloses an aqueous gel comprising a polymer of (meth)acrylamide or particular (meth) acrylamide derivative(s), particulate metal oxide(s) and an aqueous medium, a process for producing said gel, and products utilizing said gel. This aqueous gel can be produced so as to have transparency, be highly elastic and fire resistant and can prevent the spreading of flames. The aqueous gel when produced transparent, becomes cloudy when heated or cooled and is useful for the shielding of heat rays or cold radiation.

SUMMARY OF THE INVENTION

An apparatus and method for suppressing and extinguishing electrical fires in an electrical conduit. The apparatus comprising a pressurized container of fire suppressant that is attached to a dispenser by a flexible hose. The dispenser is drawn into the underground conduit during the extraction of damaged wiring or before replacement electrical lines are inserted. The dispenser can be either inserted by attachment to a line that is being removed or attached to a "fish wire" and drawn through the conduit. In operation, a first end of the dispenser is attached to a wire being drawn through the conduit. A second end of the dispenser is attached to a pressurized source of fire suppressant by use of a flexible hose. The fire suppressant is delivered to the dispenser as it is being drawn through the conduit. Any fire or embers in the conduit will be extinguished. Most any flexible hose, including a conventional garden hose, can be used for transfer of the fire suppressant into the dispenser.

Accordingly, it is an objective of the present invention to provide a method and apparatus for fire suppressant within a conduit line for extinguishment of fires.

It is a further objective of the present invention to provide a method of inserting a dispenser into a conduit, with or without electrical wires, to dispense a predetermined amount of fire suppressant or compositions thereof providing a non conductive material for use in fire suppression and extinguishment.

Still another objective of the present invention is to provide an in-pipe fire suppressant that can capture noxious and poisoness gases making them inert or entrapped in a residual that can be removed by vacuuming.

It is still yet another objective of the present invention to provide an appartus that can work with most any fire suppressant or fire suppressant compositions.

Still another objective of the present invention is to teach a process for extinguishing existing conduit fires by spraying the conduit with a fire suppressant or compositions thereof while old wiring is being removed or before new wiring is installed.

Still another objective of the invention is to teach a method of extinguishing fires in wood conduit including the use of a natural pepper or other rodent repellants to inhibit rodent infestation.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
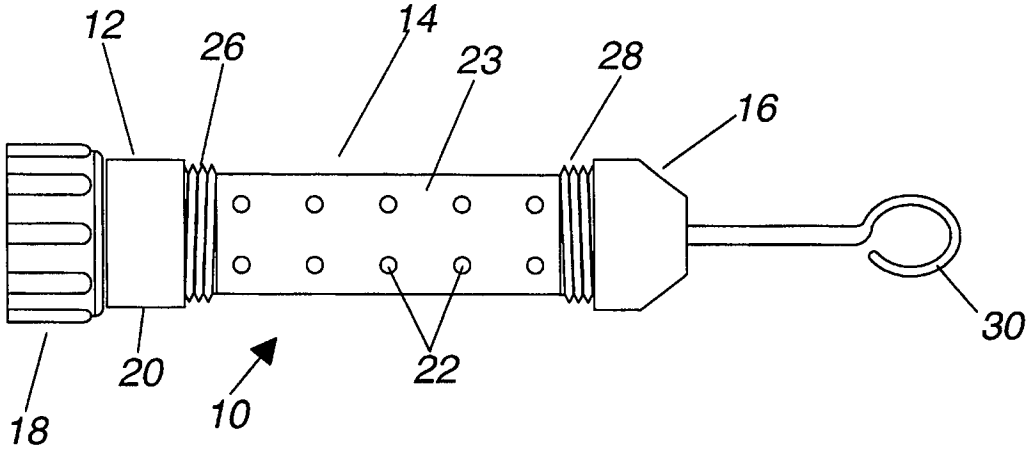
FIG. 1 is a side view of a fluid dispenser.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Definitions

The terminology used herein is for the purpose of describing particular embodiments only and is not intended to be limiting of the invention. Where a range of values is provided, it is understood that each intervening value, to the tenth of the unit of the lower limit unless the context clearly dictates otherwise, between the upper and lower limit of that range and any other stated or intervening value in that stated range, is encompassed within the invention. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in the invention.

As used herein, the singular forms "a", "an" and "the" are intended to include the plural forms as well, unless the context clearly indicates otherwise. Furthermore, to the extent that the terms "including", "includes", "having", "has", "with", or variants thereof are used in either the detailed description and/or the claims, such terms are intended to be inclusive in a manner similar to the term "comprising."

As used in this specification and the appended claims, the term "or" is generally employed in its sense including "and/or" unless the content clearly dictates otherwise.

The term "about" or "approximately" means within an acceptable error range for the particular value as determined by one of ordinary skill in the art, which will depend in part on how the value is measured or determined, i.e., the limitations of the measurement system. For example, "about" can mean within 1 or more than 1 standard deviation, per the practice in the art. Alternatively, "about" can mean a range of up to 20%, or up to 10%, or up to 5%, or up to 1% of a given value. Alternatively, the term can mean within an order of magnitude of up to 5-fold of a value. Where particular values are described in the application and claims, unless otherwise stated the term "about" meaning within an acceptable error range for the particular value should be assumed.

As used herein, the term "fire extinguishing" is meant to include the extinguishing of a fire, suppression of a fire, prevention of a fire, protection against a fire, retardation and spreading of a fire.

As used herein, a "fire extinguishing composition" is meant to be inclusive of all components of the composition. Besides the fire extinguishing super absorbent polymer(s) embodied herein, other components and additives may be included in the composition. In some embodiments, the fire extinguishing composition may comprise one or common components of fire retardant formulations, such as: fire retardant salts, conventional fire retardants, corrosion inhibitors, spoilage inhibitors, foaming agents, non foaming agents, flow conditioners, stability additives, thickening agents, conventional fire retardants or the like.

Extinguishing and Suppression of Electrical Fires

The present invention relates to a unique technique or method of extinguishing electrical fires and suppressing the spread of electrical fires. This technique utilizes fire extinguishing compositions to extinguish an electrical fire and suppress the spread of the electrical fire. The fire extinguishing compositions, such as, for example, biodegradable, super absorbent, aqueous based polymers are present in the compositions in amounts sufficient to extinguish an electrical fire and suppress the spread of the electrical fire. Examples of these polymers are: cross-linked modified polyacrylamides/potassium acrylate or polyacrylamides/sodium acrylate. Other suitable polymers include, albeit not limited to, carboxy-methylcellulose, alginic acid, cross-linked starches, and cross-linked polyamino acids. In some preferred embodiments, the fire extinguishing component is a dry powder or dry granules.

Electrical fires present different and unique problems pertaining to how these fires should be extinguished and suppressed. Water is normally used to fight fires because it can quickly cool down the burning material, there is usually a large supply of it ready for use, and it is relatively inexpensive. However, water and electricity are harmful, if not deadly to individuals, when brought into contact with each other. Normally, when water hits an active electrical circuit or electrical component, it shorts out the circuit or component, which usually results in destruction of the circuit or component. Further, when individuals are in close proximity to the water contacting the electricity, there is a strong likelihood that the water will act as a conductor and conduct the electricity to the individuals, resulting in serious injury or death of the individuals. Since water spreads rapidly in all directions on surfaces, electricity which comes in contact with the water will be conducted to wherever the water flows. Because it is difficult to prevent water from flowing to certain areas, there is a strong likelihood that individuals will be injured or killed when they come in contact with this water.

Figure 3:
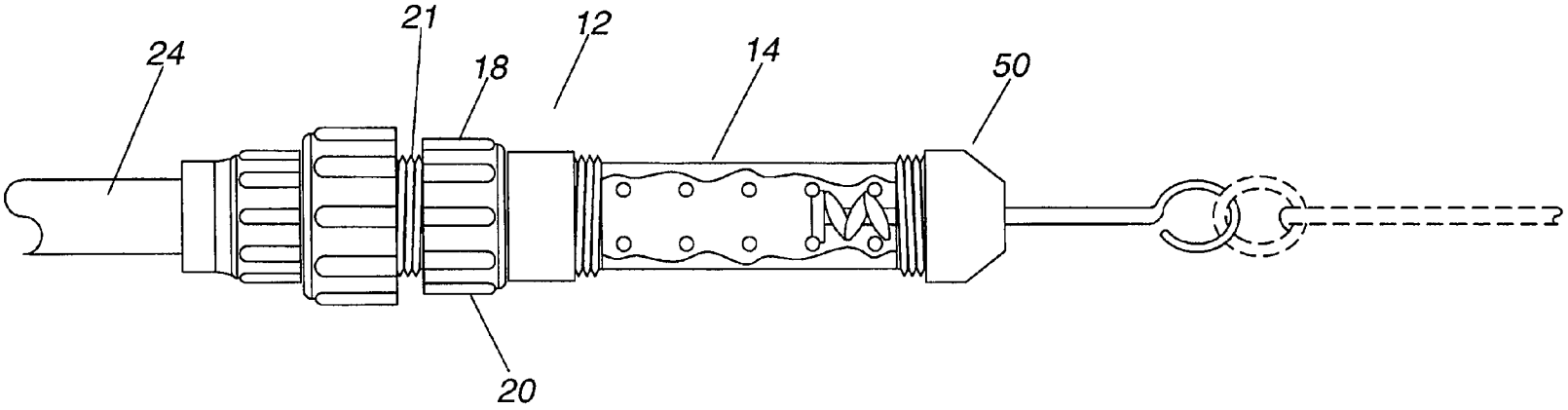
FIG. 3 is a side view of a fluid dispenser with an impeller.

Referring now to FIG. 1, set forth is a fluid dispenser (10) consisting of a coupling element (12), a body element (14), and a leading element (16). The coupling element (12) has a female hose connector (18) rotatably secured to a threaded attachment nut (20): The female hose connector (18) is preferably a ¾ inch or 1 inch connector for securement to a conventional flexible hose. The female hose connector (18) includes a flow through aperture coupled with the threaded attachment nut (20) wherein the male end (22) of a flexible hose (24) as shown in FIG. 3 can be readily attached to the female hose connector (18) allowing transfer of fire extinguishing fluids through the flexible hose into the body element (14). The body element is hollow, forming an internal cavity with an inner wall surface forming a cavity with a plurality of fluid passage apertures (22) extending from the cavity through the tubular wall to an outer wall surface (23). The ends (26 and 28) of the body element (14) are threaded for securement to attachment nut (20) and leading element (16) which each includes internal threads constructed in arranged to allow securement to the body member (14). The fluid passage apertures (22) are strategically positioned so as to distribute fire extinguishing compositions delivered through the flexible hose to all quadrants of a wooden conduit as the fluid dispenser (10) is drawn through the wooden conduit. The leading element (16) includes an attachment hook (30) for securement to either a designated fish, also known as a snake line, or a discarded electrical wire as will be further explained later in this specification. Fluid dispenser (10) can be made of most any material, metal being the most resistant to early degradation from hot spots although various composite plastics resistant to heat may also be employed.

Figure 2:
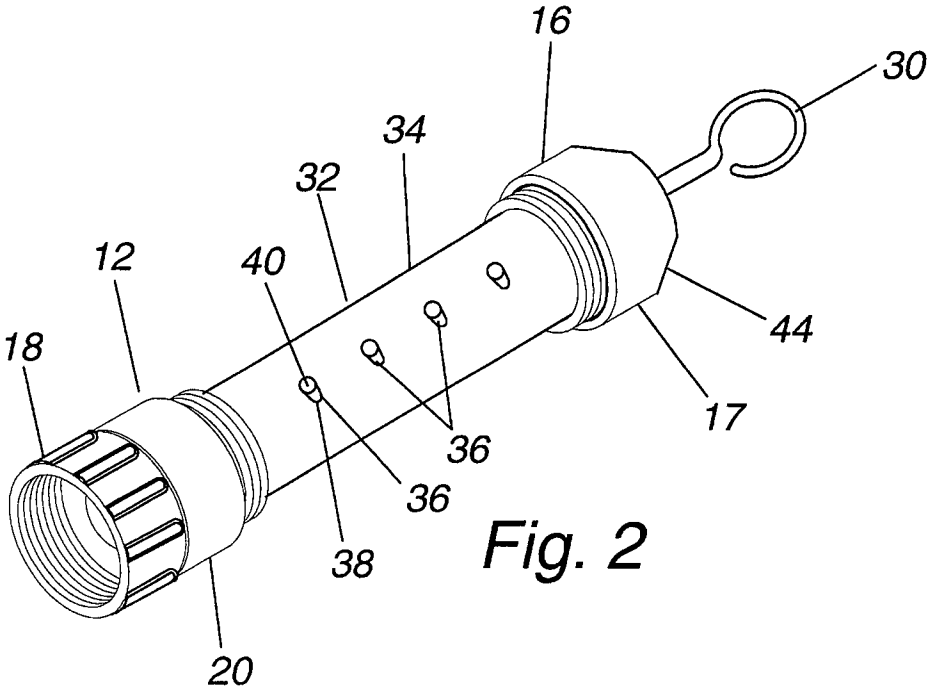
FIG. 2 is perspective view of a fluid dispenser.

FIG. 2 is an embodiment having a coupling element (12) with a flexible hose connector (18) and attachment nut (20) similar to the previous embodiment. A leading element (16) includes an attachment hook (30) positioned on the opposite side of a body element (32). The leading element (16) having a sloped entry surface (44) and a series of ridges (17) that allows twisting of the fluid dispenser (10) should the fluid dispenser impact another item while being drawn through the conduit. The body element having a cavity formed by an inner wall surface and an outer wall (34) wherein a plurality of apertures (36) are formed tangential to the normal axis of the body element causing fluid dispersion with a side thrust as depicted by an entry cut (38) providing relief directly before the aperture hole (40). The positional placement of the fluid passage apertures causing rotation of the fluid dispenser so as to allow ease of drawing the fluid dispenser through a conduit. The rotation is permitted by use of a rotatable attachment hook (30) coupled to the leading element (16) wherein the attachment allows freedom of rotation during the drawing process. Similarly, coupling element (12) allows the rotation of the body element while the flexible hose (24) need not rotate. The fluid dispenser is free to spin while being drawn through the conduit assuring a proper coating of the conduit and making it easier to draw the fluid dispenser past conduit imperfections. Should the fluid dispenser engage an imperfection in the conduit, such as a bend or wires that are left within the conduit, the fluid dispenser essentially walks around the imperfection as the rotation with the angular frontal surface (44) allows the fluid dispenser to be snaked through the conduit without impedance of items that remain within the conduit. Further, the outer surface of the leading element (16) may include raised ridges (17) allow the fluid dispenser (10) to crawl over the imperfection when the leading element (16) is impinged upon.

Figure 4:
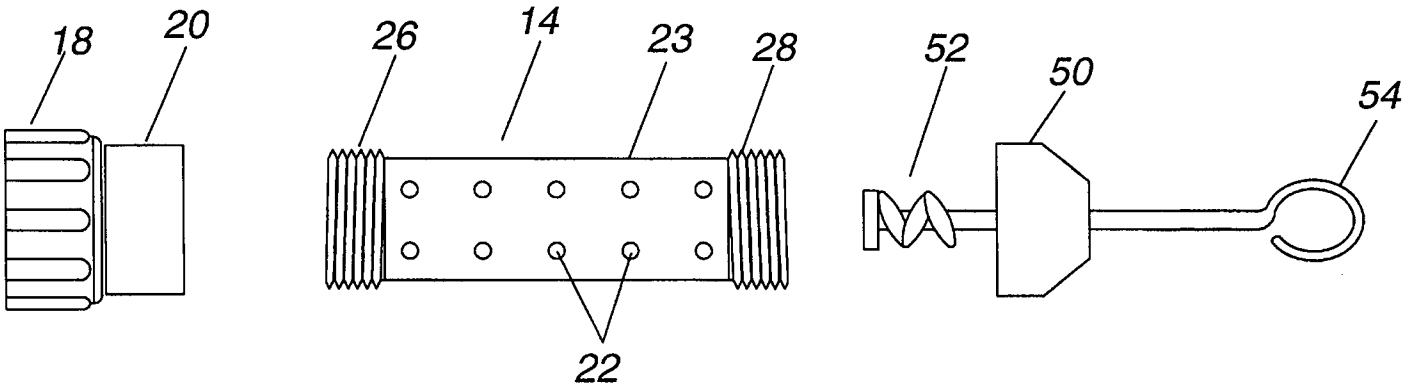
FIG. 4 is an exploded view of a fluid disperser depicted in FIG. 3.
Figure 5:
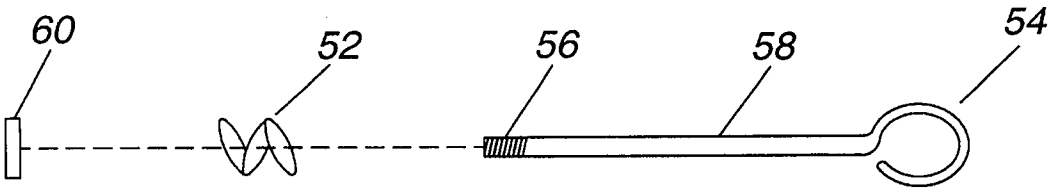
FIG. 5 is a exploded view of a leading element with an impeller.

Referring to FIGS. 3 through 5, set forth is another embodiment having a coupling element (12) with the threaded attachment nut (20) and female hose connector (18). As depicted in FIG. 3 the flexible hose (24) having a male insertion (21) mates with the female hose connector (18) allowing fluid to transfer through the flexible hose into the body element (14). The body element (14) is hollow, forming an internal cavity with an inner wall surface forming a cavity with a plurality of fluid passage apertures (22) extending from the cavity through the tubular wall to an outer wall surface (23). The ends (26 and 28) of the body element (14) are threaded for securement to the attachment nut (20) of the hose connector (18) and the leading element (16) which includes internal threads constructed and arranged to allow securement to the body member (14). The fluid passage apertures (22) are strategically positioned so as to distribute fire extinguishing compositions delivered through a flexible hose to all quadrants of a wooden conduit as the fluid dispenser (10) is drawn through the wooden conduit.

The leading element (50) is threadably attached to the body element (14) and includes an impeller (52) mounted to the attachment hook (54) which extends through the leading element body (50) and placement into the cavity within the body element (14). Fluid fire extinguishing compositions brought into the body element for dispersion through the apertures (22) engage the impeller (24) causing rotation of the body element for optimum dispersion of the fire extinguishing composition to the fluid passages (20). The attachment hook (54) having a threaded end (56) with the impeller (52) slideably engaged with the shank (58) and held to the attachment hook by fastener nut (60).

Figure 6:
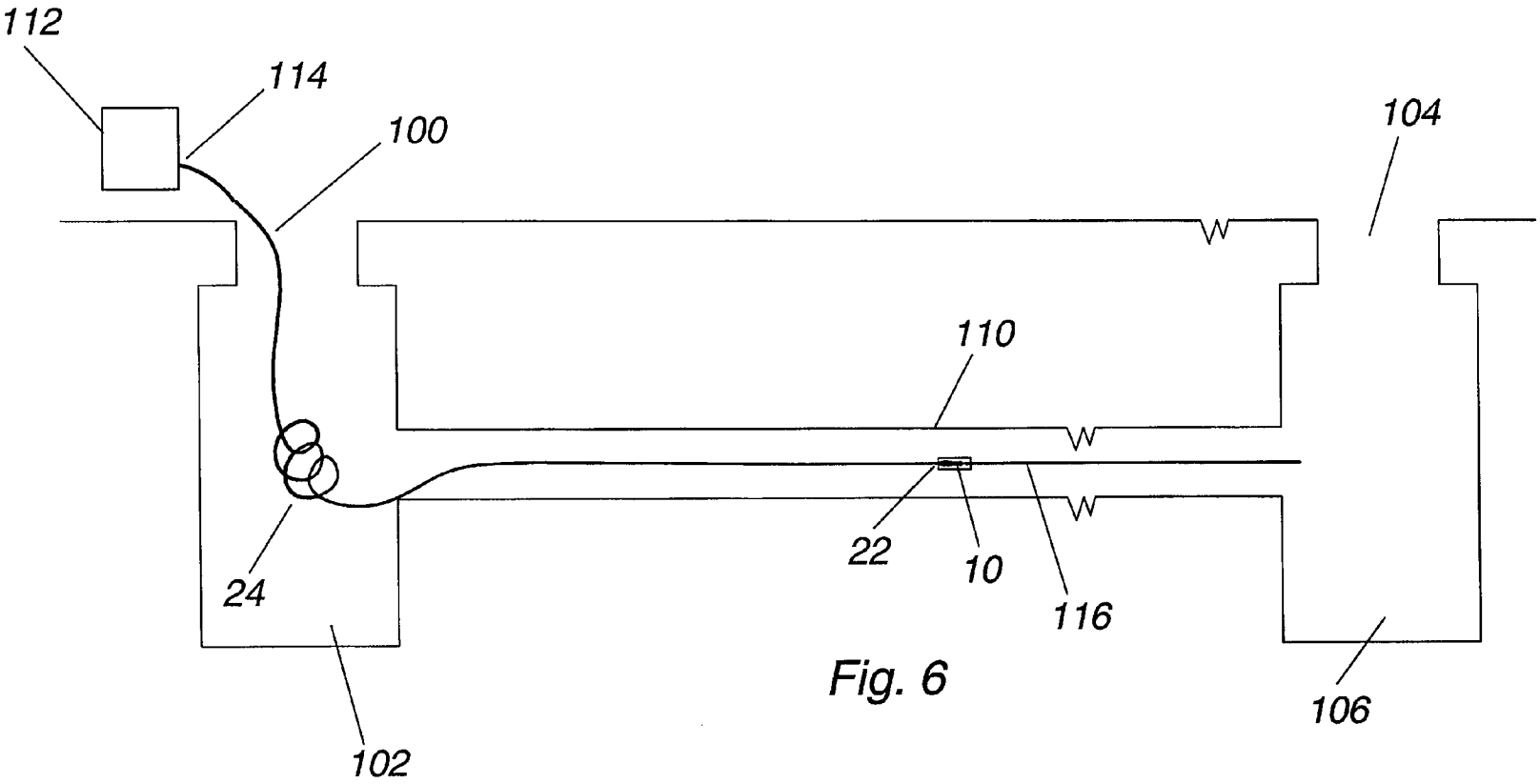
FIG. 6 is a pictorial view of the apparatus treating an underground conduit.

Referring now to FIG. 6, set forth is a pictorial of an underground utility having a first opening (100) with a work cavity (102) connected to a second access opening (104) and work cavity (106) by a wooden conduit (110). By way of illustration a source of pressurized fire extinguishing composition is placed within container (112). The flexible hose (24) having a first end (114) and a second end (21) attached to the fluid dispenser (10) drawn through the wooden conduit by either a fish line (116) or a discarded electrical line. An individual within cavity (106) can pull the fluid dispenser through the conduit (110) with sufficient flexible hose to allow the fluid dispenser that enters to work cavity (102) to exit into work cavity (106) there by coating the entire interior of the wooden conduit with the fire extinguishing fluid placed within container (112). The pressurized fire extinguishing composition can comprise any known or conventional fire extinguishing or fire suppressant components. In preferred embodiments, the fire extinguishing composition comprises biodegradable, super absorbent, aqueous based polymers. Examples of these polymers are cross-linked modified polyacrylamides/potassium acrylate or polyacrylamides/sodium acrylate. Other suitable polymers include, albeit not limited to, carboxy-methylcellulose, alginic acid, cross-linked starches, and cross-linked polyaminoacids. Examples of known fire suppressants include without limitation, those marketed under the brand name of FIREICE, CEMDAL AQUA SHIELD, BARRICADE, WILDFIRE AFG FIREWALL, BIOCENTRAL BLAZETAMMER, PHOS-CHEK INSUUL, and THERMO GEL. In some embodiments, the fire extinguishing composition comprises one or more fire extinguishing or fire suppressant compounds. In other embodiments, the fire extinguishing composition comprises one or more common components of fire suppressant formulations, such as: fire suppressant salts, known or conventional fire suppressants, corrosion inhibitors, spoilage inhibitors, foaming agents, non foaming agents, flow conditioners, stability additives, thickening agents, pigments, or the like. The fire extinguishing composition may be in a pressurized tank that allows for instant delivery, or be held in an unpressurized tank and transferred by a pressure pump.

In some embodiments, a conventional fire extinguishing component or fire suppressant comprises penta-bromodiphenyl ether, octa-bromodiphenyl ether, deca-bromodiphenyl ether, short-chain chlorinated paraffins (SCCPs), medium-chain chlorinated paraffins (MCCPs), hexabromocyclododecane (HBCD), tetrabromobisphenol A (TBBPA), tetrabromobisphenol A ether, pentabromotoluene, 2,3-dibromopropyl-2,4,6-tribromophenyl ether, tetrabromobisphenol A, bis(2,3-dibromopropyl ether), tris (tribromophenoxy)triazine, tris(2-chloroethyl)phosphate (TCEP), tris(2-chloro-l-methylethyl)phosphate (TCPP or TMCP), tris (1,2-dichloropropyl)phosphate (TDCP), 2,2-bis (chloromethyl)-trimethylene bis(bis(2-chloroethyl)phosphate), melamine cyanurate, antimony trioxide $Sb_2O_3$ (ATO), boric acid, ammonium polyphosphate (APP), aluminum ammonium polyphosphate, aluminum hydroxide, magnesium hydroxide red phosphorous, 1,2-bis(tribromophenoxy)ethane, 2,4,6-tribromophenyl glycidyl ether, tetrabromo phthalic anhydride, 1,2-bis(tetrabromo phthalimide) ethane, tetrabromo dimethyl phthalate, tetrabromo disodium phthalate, decabromodiphenyl ether, tetradecabromodi(phenoxyl)benzene, 1,2-bis(pentabromophenyl)ethane, bromo-trimethyl-phenyl-hydroindene, pentabromobenzyl acrylate, pentabromobenzyl bromide, hexabromobenzene, pentabromotoluene, 2,4,6-tribromophenyl maleimide, hexabromo cyclododecane, N,N'-1,2-bis(dibromonorbornyl dicarbimide)ethane, pentabromochloro-cyclohexane, tri (2,3-dibromopropyl)isocyanurate, bromo-styrene copolymer, tetrabromobisphenol A-carbonate oligomer, polypentabromobenzyl acrylate, polydibromophenylene ether; chlorinated flame retardants such as dechlorane plus, HET anhydride(chlorendic anhydride), perchloro pentacyclodecane, tetrachloro bisphenol A, tetrachlorophthalic anhydride, hexachlorobenzene, chlorinated polypropylene, chlorinated polyvinyl chloride, vinyl chloride-vinylidene chloride copolymer, chlorinated polyether, hexachloroethane; organic phosphorus flame retardants such as 1-oxo-4-hydroxymethyl-2,6,7-trioxa-1-phosphabicyclo[2,2,2]octane, 2,2-dimethyl-1,3-propanediol-di(neopentyl glycol) diphosphate, 9,10-di hydro-9-oxa-10-phosphaphenanthrene-10 oxide, bis(4-carboxyphenyl)-phenyl phosphine oxide, bis(4-hydroxyphenyl)-phenyl phosphine oxide, phenyl(diphenyl sulfone) phosphate oligomer; phosphorus-halogenated flame retardants such as tris(2,2-di(bromomethyl)-3-bromopropyl)phosphate, tris(dibromophenyl)phosphate, 3,9-bis(tribromophenoxy)-2,4,8,10-tetraoxa-3,9-diphosphaspiro[5,5]-3,9-di-oxo-undecane, 3,9-bis(pentabromophenoxy)-2,4,8, 10-tetraoxa-3,9-diphosphaspiro[5,5]-3,9-dioxo-undecane, 1-oxo-4-tribromophenoxycarbonyl-2,6,7-trioxa-1-phosphabicyclo[2,2,2]octane, p-phenylene-tetrakis(2,4,6-tribromophenyl)-diphosphate, 2,2-di (chloromethyl)-1,3-propanediol-di(neopentyl glycol) diphosphate, 2,9-di(tribromo-neopentyloxy)-2,4,8,10-tetraoxa-3,9-diphosphaspiro[5,5]-3-,9-dioxo-undecane; nitrogen-based flame retardants or phosphorus-nitrogen-based flame retardants such as melamine, melamine cyanurate, melamine orthophosphate, dimelamine orthophosphate, melamine polyphosphate, melamine borate, melamine octamolybdate, cyanuric acid, tris(hydroxyethyl) isocyanurate, 2,4-diamino-6-(3,3,3-trichloro-propyl)-1,3,5-triazine, 2,4-di(N-hydroxymethyl-amino)-6-(3,3,3-trichloro-propyl-1,3,5-triazine), diguanidine hydrophosphate, guanidine dihydrogen phosphate, guanidine carbonate, guanidine sulfamate, urea, urea dihydrogen phosphate, dicyandiamide, melamine bis(2,6,7-trioxa-phospha-bicyclo[2.2.2]octane-1-oxo-4-methyl)-hydroxy-phosphate, 3,9-dihydroxy-3,9-dioxo-2,4,8,10-tetraoxa-3,9-diphosphaspiro[5.5]u-ndecane-3,9-dimelamine, 1,2-di(2-oxo-5,5-dimethyl-1,3-dioxa-2-phosphacyclohexyl-2-amino) ethane, N,N'-bis(2-oxo-5,5-dimethyl-1,3-dioxa-2-phosphacyclohexyl)-2,2'-m-phenyle-nediamine, tri(2-oxo-5,5-dimethyl-1,3-dioxa-2-phosphacyclohexyl-2-methyl)amine, hexachlorocyclotriphosphazene; and inorganic flame retardants such as red phosphorus, ammonium polyphosphate, diammonium hydrophosphate, ammonium dihydrogen phosphate, zinc phosphate, aluminum phosphate, boron phosphate, antimony trioxide, aluminum hydroxide, magnesium hydroxide, hydromagnesite, alkaline aluminum oxalate, zinc borate, barium metaborate, zinc oxide, zinc sulfide, zinc sulfate heptahydrate, aluminum borate whisker, ammonium octamolybdate, ammonium heptamolybdate, zinc stannate, stannous oxide, stannic oxide, ferrocenc, ferric acetone, ferric oxide, ferro-ferric oxide, ammonium bromide, sodium tungstate, potassium hexafluorotitanate, potassium hexafluorozirconate, titanium dioxide, calcium carbonate, barium sulfate, sodium bicarbonate, potassium bicarbonate, cobalt carbonate, zinc carbonate, basic zinc carbonate, heavy magnesium carbonate, basic magnesium carbonate, manganese carbonate, ferrous carbonate, strontium carbonate, sodium potassium carbonate hexahydrate, magnesium carbonate, calcium carbonate, dolomite, basic copper carbonate, zirconium carbonate, beryllium carbonate, sodium sesquicarbonate, cerium carbonate, lanthanum carbonate, guanidine carbonate, lithium carbonate, scandium carbonate, vanadium carbonate, chromium carbonate, nickel carbonate, yttrium carbonate, silver carbonate, praseodymium carbonate, neodymium carbonate, samarium carbonate, europium carbonate, gadolinium carbonate, terbium carbonate, dysprosium carbonate, holmium carbonate, erbium carbonate, thulium carbonate, ytterbium carbonate, lutetium carbonate, aluminium diacetate, calcium acetate, sodium bitartrate, sodium acetate, potassium acetate, zinc acetate, strontium acetate, nickel acetate, copper acetate, sodium oxalate, potassium oxalate, ammonium oxalate, nickel oxalate, manganese oxalate dihydrate, iron nitride, sodium nitrate, magnesium nitrate, potassium nitrate, zirconium nitrate, calcium dihydrogen phosphate, sodium dihydrogen phosphate, sodium dihydrogen phosphate dihydrate, potassium dihydrogen phosphate, aluminum dihydrogen phosphate, ammonium dihydrogen phosphate, zinc dihydrogen phosphate, manganese dihydrogen phosphate, magnesium dihydrogen phosphate, disodium hydrogen phosphate, diammonium hydrogen phosphate, calcium hydrogen phosphate, magnesium hydrogen phosphate, ammonium phosphate, magnesium ammonium phosphate, ammonium polyphosphate, potassium metaphosphate, potassium tripolyphosphate, sodium trimetaphosphate, ammonium hypophosphite, ammonium dihydrogen phosphite, manganese phosphate, dizinc hydrogen phosphate, dimanganese hydrogen phosphate, guanidine phosphate, melamine phosphate, urea phosphate, strontium dimetaborate hydrogen phosphate, boric acid, ammonium pentaborate, potassium tetraborate octahydrate, magnesium metaborate octahydrate, ammonium tetraborate tetrahydrate, strontium metaborate, strontium tetraborate, strontium tetraborate tetrahydrate, sodium tetraborate decahydrate, manganese borate, zinc borate, ammonium fluoroborate, ammonium ferrous sulfate, aluminum sulfate, potassium aluminum sulfate, ammonium aluminum sulfate, ammonium sulfate, magnesium hydrogen sulfate, aluminum hydroxide, magnesium hydroxide, iron hydroxide, cobalt hydroxide, bismuth hydroxide, strontium hydroxide, cerium hydroxide, lanthanum hydroxide, molybdenum hydroxide, ammonium molybdate, zinc stannate, magnesium trisilicate, telluric acid, manganese tungstate, manganite, cobaltocene, 5-aminotetrazole, guanidine nitrate, azobisformamide, nylon powder, oxamide, biuret, pentaerythritol, decabromodiphenyl ether, tetrabromophthalic anhydride, dibromoneopentyl glycol, potassium citrate, sodium citrate, manganese citrate, magnesium citrate, copper citrate, ammonium citrate, nitroguanidine.

In some embodiments, the fire extinguishing composition is in dry form e.g. powder, granules and the like. In other embodiments, the fire extinguishing compositions are hydrated to form liquids or gels. The fire extinguishing compositions can be a liquid, foam, or semi-liquid form, such as, for example, a gel having varying viscosities.

In the embodiments wherein the fire extinguishing compositions comprise an aqueous admixture of super absorbent polymer and water having properties which enable the super absorbent polymer and water admixture to be confined to a particular area because of its relatively high viscosity. The properties of the admixture, in particular its viscosity, enable the admixture to remain on vertical, horizontal and curved surfaces formed by the conduit and wires placed therein. Unlike pure water, the admixture does not provide an electrically conductive path. The present invention adds a predetermined amount of the super absorbent polymer to a predetermined amount of water to obtain an admixture which has properties that enable the admixture to suppress the spread of an electrical fire and extinguish any fire that has attached itself to the individual. For example, the amounts of about 1 to 5 pounds of dry super absorbent FIREICE® polymer to about 20 to 40 gallons of water provides an admixture that adheres to the conduit walls.

Currently, firefighters are known to apply water to the electrical conduits which are on fire and which are typically adjacent to other conduits and components making it difficult to control. Contact with electrical components can result in substantial damage adjacent conduits/components. The present invention enables a controlled dispersion of fire extinguishing compositions to the interior walls of an underground wooden conduit for the primary purpose of extinguishing and suppressing the electrical fire at the immediate point of origin and maintaining a level of fire suppression to assure that no embers remain. The admixture adheres to the interior of the conduit, without affecting adjacent conduits/components. Thus, a substantial safety factor is gained because electrical conduits/components are not sprayed and the admixture is not conductive like water.

In rare instances, the electrical power is not turned off which may result in serious injury and/or death of the firefighters when they apply water to the electrical fire. In some embodiments, a fire extinguishing composition comprises properties such that the fire extinguishing compositions will not readily flow or run from the area into which the fire extinguishing composition has been applied. Therefore, even in embodiments wherein the fire extinguishing composition contains water, when the fire extinguishing compositions are applied to a live electrical wire or component, the electricity will not travel back to the firefighter because the fire extinguishing compositions will remain in the immediate area where the fire extinguishing composition has been applied due to its physical properties and not travel down the conduit.

In addition, water does not suppress noxious and/or toxic gases produced by burning electrical wires, insulation and other components. The admixture of potassium based super absorbent polymer, marketed under the trademark FIREICE®, has physical and chemical properties that operate as a fire extinguisher and to entrap and retain noxious and/or toxic gasses. This is an important advantage that the present invention has over the prior art because it prevents the noxious and/or toxic gases from reaching and affecting the lineman and/or firefighters. When the fire extinguishing composition is used to suppress a fire in conduits made from wood, the use of a rodent repellant such as cayenne pepper can be included. Rodents remain adverse to peppers and the saturating of the conduit with pepper leaves a natural rodent repellant that will last for years. However, any commercially available rodent repellant may be used.

The invention has been described in detail with reference to preferred embodiments thereof. However, it will be appreciated that those skilled in the art, upon consideration of this disclosure, may make modifications and improvements within the spirit and scope of the invention.

All documents mentioned herein are incorporated herein by reference. All publications and patent documents cited in this application are incorporated by reference for all purposes to the same extent as if each individual publication or patent document were so individually denoted. By their citation of various references in this document, Applicants do not admit any particular reference is "prior art" to their invention.

EXAMPLES

The following non-limiting Examples serve to illustrate selected embodiments of the invention. It will be appreciated that variations in proportions and alternatives in elements of the components shown will be apparent to those skilled in the art and are within the scope of embodiments of the present invention.

Tests were carried out with the super absorbent polymer marketed under the trademark FIREICE®. The admixture is non-conductive and capable of suppressing harmful air emission released from electrical files.

1. Test Description

A total of five field test air sampling collections were undertaken on Jan. 18, 2011, at the High Current Laboratory (HCL) to evaluate the air emissions released from the application of Applicant super absorbent polymer marked under the trademark FIREICE® to artificially faults generated using copper and aluminum cables. The five test scenarios were air sampled for airborne metals and organics. The description of the tests is given in Table 1.

TABLE 1

Test description

| Test # | Shot # | Test description | Cable description |
|---|---|---|---|
| 1 | 119 | New cables with copper conductor artificially faulted to create arc with no FIREICE ® added. Target fault current: 2 kA. Fault duration: until fault self-extinguished. | coned 500 kcmil Cu 600 V EAM/LSNH installed in coned precast concrete distribution box type B-3.6 |
| 2 | 120 | New cables with copper conductor artificially faulted to create arc with FIREICE ® added at the on-set of arc. Target fault current: 2 kA. Fault duration: until fault self-extinguished. | coned 500 kcmil Cu 600 V EAM/LSNH installed in coned precast concrete distribution box type B-3.6 |
| 3 | 121 | New cables with copper conductor artificially faulted to create arc with FIREICE ® added at the on-set of arc - this was a repeat of test #2 due to poor arc generation and non-propagation of arc. Target fault current: 2 kA. Fault duration: until fault self-extinguished. | coned 500 kcmil Cu 600 V EAM/LSNH installed in coned precast concrete distribution box type B-3.6 |
| 4 | 122 | New cables with aluminum conductor artificially faulted to create arc with FIREICE ® added at the on-set of arc. | coned 350 MCM Al 600 V EPR installed in coned precast concrete distribution box type B-3.6 |
| 5 | 123 | New cables with aluminum conductor artificially faulted to create arc with "FIREICE ®" added to concrete box to cover faulted cables prior to high current being applied to create arc. Target fault current: 2 kA. Fault duration: until fault self-extinguished. | coned 350 MCM Al 600 V EPR installed in coned precast concrete distribution box type B-3.6 |

In all the tests the cables were installed at the bottom of the concrete box, and the fault between the cables was created using a fuse wire. The approximate dimensions of the interior volume of the concrete box are: 33"×33"×24". One calorimeter was installed above the concrete box to measure the incident energy generated by the fault.

The sampling equipment consisted of five separate sampling trains, each with a sampling pump drawing air through various air sampling components using a calibrated mass flow controller to maintain constant flow. The sampling time for each train was two minutes during each of the 5 arc test scenarios. For each sampling train a flow rate was selected based on the type of air sample being collected. The five sampling trains consisted of the following components and the air flow rate utilized:

1. A sampling train consisting of a MCE (mixed cellulose ester) filter in a cartridge filter holder for aerosol collection generated during the arc. The air flow rate through the filter was set to 1 L/min.

2. A sampling train for organic compounds using two CARBOTRAP™ 300 sampling tubes in series (front-back arrangement) was placed with the front sampling tube inlet at the edge of the concrete bunker. The air flow rate for the organics sampling tube train was 0.050 L/min.

3. A sampling train consisting of three impingers in series with 1M nitric acid in the first two impingers and an empty third impinger was used to trap airborne metals. The metals train air flow rate was set to 0.50 L/min.

4. A sampling train identical to the one described in 3 but with 0.5M KOH added to the first two impingers and an empty third impinger was setup plus an additional CARBOTRAP™ 300 organic compound sampling train as described in 2 was added in series to the outlet of the last impinger. The air sampling flow rate was set to 0.25 1/min for this train.

5. A final sampling train consisting of 3 impingers in series as described in 3 but with KOH added to the first two impingers and an empty third impinger to capture acidic species possibly generated during the FIREICE® tests. The air sampling flow rate was set to 0.25 L/min for this train.

2. Organic Compound Sampling Results—Carbotrap™ 300 Tube Analyses

The organic compounds released to air were captured using CARBOTRAP™ 300 tubes after the air sample passed through a KOH impinger train. The sampling flow rate was 0.25 L/min. The total mass of organic compounds collected during each of the five arc fault tests are given in Table 2. The organic compounds identified in the air samples are summarized in Table 3.

TABLE 2

Total Mass of Organic Compounds Collected on CARBOTRAP ™ 300 Sample Tubes and Estimated FIREICE ® Inhibition Ratio for Organic Compound Release

| Test Number & Description | Total Mass of Organics Collected on CARBOTRAP ® 300 Tubes | Minimum Removal Efficiency Compared to Test 1 |
|---|---|---|
| 1 Pair of New Neoprene Copper Cables - No FIREICE ® Applied | 615 | — |
| 2 Pair of New Neoprene Jacketed Copper Cables - FIREICE ®-Added at On-Set of Arc | 189 | 3.2 |
| 3 Pair of New Neoprene Jacketed Copper Cables - FIREICE ®-Added at On-Set of Arc (Repeat) | 138 | 4.5 |
| 4 Pair of New Neoprene Jacketed Aluminum Cables - FIREICE ® Added at On-Set of Arc | No Organic Compounds Detected | >61.5* |
| 5 Pair of New Neoprene Jacketed Aluminum Cables - FIREICE ® Added Prior to Arc Generation | No Organic Compounds Detected | >61.5* |

Note:

— Assumed minimum removal efficiency is assumed to be >61.5 as detection limit for any single organic compound is 10 ng.

TABLE 3

Organic Compounds Identified in High Flow Samples

| Test Number & Description | Organic Compounds Collected on CARBOTRAP ™ 300 Tubes Passage Through KOH Impingers | Total Organic Compound Mass (Front + Back) (ng) |
|---|---|---|
| 1 Pair of New Neoprene Copper Cables - No FIREICE ® Added | ethane-1-chloro-1,1 difluoro* | 48000* |
| | 2-butene, 2-methyl | 18 |
| | 1,3-butadiene, 2-methyl | 40 |
| | 1,3 pentadiene | 35 |
| | 1,4 pentadiene | 14 |
| | cyclopentane | 23 |
| | 1-pentene, 2-methyl | 36 |
| | benzene | 62 |
| | 1,4-cyclohexadiene | 25 |
| | 3-hexen-1-ol | 28 |
| | toluene | 237 |
| | ethylbenzene | 48 |
| | styrene** | 2740** |
| | a-methyl styrene** | 53** |
| 2 Pair of New Neoprene Jacketed Copper Cables - FIREICE ®-Added at On-Set of Arc | ethane-1-chloro-1,1-difluoro | 68* |
| | 1,3-butadiene | 14 |
| | 1-pentene, 2-methyl | 21 |
| | propane, 2-methyl-1-nitro | 31 |
| | 3-heptene | 8 |
| | benzene | 62 |
| | butane, I-chloro-2-methyl | 25 |
| | styrene** | 99** |
| | unknown | 28 |
| 3 Pair of New Neoprene Jacketed Copper Cables - FIREICE ®-Added at On-Set of Arc (Repeat) | ethane-1-chloro-1,1-difluoro | 264* |
| | 1-propene, 2-methyl | 16 |
| | 1,3-butadiene | 40 |
| | 2-butene, 2-methyl | 12 |
| | 1-pentene, 2-methyl | 25 |
| | benzene | 34 |
| | unknown | 11 |

TABLE 3-continued

| Organic Compounds Identified in High Flow Samples | | |
|---|---|---|
| Test Number & Description | Organic Compounds Collected on CARBOTRAP ™ 300 Tubes Passage Through KOH Impingers | Total Organic Compound Mass (Front + Back) (ng) |
| 4 Pair of New Neoprene Jacketed Aluminum Cables - FIREICE ® Added at On-Set of Arc | No organic compounds detected on both front and back CARBOTRAP ® 300 tubes | 0 |
| 5 Pair of New Neoprene Jacketed Aluminum Cables - FIREICE ® Added Prior to Arc Generation | No organic compounds identified on both front and back CARBOTRAP ™ 300 | 0 |

Notes:

*The ethane-1-chloro-1,1-difluoro is suspected to be contamination resulting from the partial decomposition of impinger train holder used during testing. The Freon HCFC 142b released during tests 1 to 3 is the trapped blowing agent used to make the closed cell foam. The foam was used to support and secure the impinger trains. Not included in organic compound mass reported.

**The styrene and α-methyl styrene are unintentional contaminants generated from the destruction of the aerosol filter holder used during the first arc fault Test-1. The filter-holder was too close to the arc-fault zone and did not survive Test-1. The styrene values are not included in organic compound mass reported.

Direct Air Sampling

The total mass of organic compounds in the air samples collected directly on to CARBOTRAP™ 300 tubes during each of the five arc fault tests are given in Table 4. The organic compounds captured with the CARBOTRAP™ 300, tubes and subsequently detected during analysis are listed in Table 5. The sampling flow rate was 0.05 L/min.

TABLE 4

| Total Mass of Organic Compounds on Direct Air Sample onto CARBOTRAP ™ 300 Tubes and FIREICE ® Inhibition Ratio | | |
|---|---|---|
| Test Number & Description | Total Mass of Organics Collected on. CARBOTRAP ™ 300 | Minimum Removal Efficiency Compared to Test 1 |
| 1 Pair of New Neoprene Jacketed Copper Cables - No FIREICE ® | 158 | — |
| 2 Pair of New Neoprene Jacketed Copper Cables - FIREICE ®-Added | 65 | 2.4 |
| 3 Pair of New Neoprene Jacketed Copper Cables - FIREICE ®-Added | 15 | >10 |
| 4 Pair of New Neoprene Jacketed Aluminum Cables - FireIce ® Added at On-Set of Arc | None Detected | >15.8 |
| 5 Pair of New Neoprene Jacketed Aluminum Cables - FIREICE ® Added Prior to Arc Generation | 10 | 15.8 |

The total organic compound concentration measured directly with the CARBOTRAP™ 300 tubes associated with the copper cable arc fault in Test-1 is estimated to be 1.6 mg/m3 without the application of FIREICE®. For Test-2 through Test-5 the organic compound concentrations are estimated to be 0.6 mg/m3, 0.15 mg/m3, 0.0 mg/m3 and 0.1 mg/m3, respectively.

The FIREICE® application is effective in reducing organic emissions for both the copper cables and the aluminum cables. The removal efficiencies estimated in Table 2 and Table 4 compare well. The application of FIREICE® reduces organic emissions when applied with the arc fault is active. The presence of external contamination confirms the effective organic sampling in the vicinity of the arc fault during the five tests.

TABLE 5

| Organic Compounds Identified in Direct Air Samples Collected on CARBOTRAP ™ 300 Tubes | | |
|---|---|---|
| Test Number & Description | Organic Compounds Collected on CARBOTRAP ™ 300 | Organic Compound Mass (ng/tube) |
| 1 Pair of New Neoprene Copper Cables - No FIREICE ® Added | Ethane-1-chloro-1,1 difluoro* | 53* |
| | 1-pentene, 2-methyl | 15 |
| | Benzene | 64 |
| | toluene** | 41 |

TABLE 5-continued

Organic Compounds Identified in Direct Air Samples Collected on CARBOTRAP ™ 300 Tubes

| | Test Number & Description | Organic Compounds Collected on CARBOTRAP ™ 300 | Organic Compound Mass (ng/tube) |
|---|---|---|---|
| | | Styrene | 70 |
| | | methyl styrene** | 217* |
| | | isobutyl nitrile | 11 |
| | | propane, 2-methyl-1-nitro | 14 |
| | | unknown | 13 |
| 2 | Pair of New Neoprene Jacketed Copper Cables - FIREICE ®-Added at On-Set of Arc | 1-propene, 2-methyl | 8 |
| | | 1,3 butadiene | 16 |
| | | 2-butene, 2-methyl | 8 |
| | | 1-pentene, 2-methyl | 23 |
| | | unknown | 10 |
| 3 | Pair of New Neoprene Jacketed Copper Cables - FIREICE ®-Added at On-Set of Arc (Repeat) | 1-pentene, 2-methyl | 15 |
| 4 | Pair of New Neoprene Jacketed Aluminum Cables - FIREICE ® Added at On-Set of Arc | No organic compounds detected on both front and back CARBOTRAP ™ 300 tubes | 0 |
| 5 | Pair of New Neoprene Jacketed Aluminum Cables - FIREICE ® Added Prior to Arc Generation | No organic compounds identified on both front and back CARBOTRAP ™ 300 tubes | 0 |
| | | Unknown peak (Front tube only) | 10 |

Notes:

*The ethane-1-chloro-1,1-difluoro is suspected to be contamination resulting from the partial decomposition of impinger train holder used during testing. The Freon HCFC 142b released during testing is the trapped blowing agent used to make the closed cell foam. The foam was used to support and secure the impinger trains. The Freon was not included in organic compound mass reported.

**The styrene and α-methyl styrene are unintentional contaminants generated from the destruction of the aerosol filter holder used during the first arc fault Test-1. The filter-holder was too close to the arc-fault zone and did not survive Test-1. The styrene values are not included in organic compound mass reported.

TABLE 6

Metals Analysis Results (PPM) Filter Pack Sampling ~2 m Above Arc Fault

| Metal | Blank (Avg) | Test 2 (Cu) | Test 3 (Cu) | Test 4 (Al) | Test 5 (Al) |
|---|---|---|---|---|---|
| Al | <0.5 | 3.15 | 6.81 | 1.48 | <0.5 |
| Ca | 2.15 | 1.80 | 4.96 | 2.52 | 1.93 |
| Cu | <1.5 | 94.8 | 312 | 1.98 | <1.5 |
| Fe | <0.25 | <0.25 | 2.85 | <0.25 | <0.25 |
| K | 67 | 68 | 39 | 28 | 23 |
| Mg | 0.19 | 8.4 | 18.9 | 0.25 | <0.1 |
| Na | <2.5 | <2.5 | 5.8 | <2.5 | <2.5 |
| P | <1 | <1 | 1.2 | <1 | <1 |
| S | <1 | <1 | 3.7 | <1 | <1 |
| Si | <1 | 4.3 | 20.5 | <1 | <1 |
| Ag | <0.005 | <0.005 | 0.007 | <0.005 | <0.005 |
| As | <0.05 | <0.05 | <0.05 | <0.05 | <0.05 |
| B | <0.05 | <0.05 | <0.05 | <0.05 | <0.05 |
| Ba | 0.007 | 0.012 | 0.022 | 0.008 | 0.006 |
| Bi | <0.005 | <0.005 | <0.005 | <0.005 | <0.005 |
| Be | <0.005 | <0.005 | <0.005 | <0.005 | <0.005 |
| Cd | <0.005 | <0.005 | <0.005 | <0.005 | <0.005 |
| Co | <0.005 | <0.005 | <0.005 | <0.005 | <0.005 |
| Cr | <0.005 | <0.005 | <0.005 | <0.005 | <0.005 |
| Cs | <0.005 | <0.005 | <0.005 | <0.005 | <0.005 |
| Li | <0.005 | <0.005 | 0.013 | <0.005 | <0.005 |
| Mn | 0.005 | 0.006 | 0.053 | 0.007 | 0.006 |
| Mo | <0.005 | <0.005 | <0.005 | <0.005 | <0.005 |
| Ni | 0.010 | 0.013 | 0.024 | 0.016 | 0.011 |
| Pb | <0.005 | 1.93 | 4.79 | 0.063 | 0.015 |
| Sb | 0.003 | 2.17 | 5.19 | 0.072 | 0.017 |
| Se | <0.05 | <0.05 | <0.05 | <0.05 | <0.05 |
| Sn | 0.029 | 0.036 | 0.028 | 0.006 | 0.005 |
| Sr | 0.007 | 0.006 | 0.028 | 0.009 | 0.006 |
| Th | <0.005 | <0.005 | <0.005 | <0.005 | <0.005 |
| Ti | 0.151 | 0.122 | 0.309 | 0.007 | 0.007 |
| Th | <0.005 | <0.005 | <0.005 | <0.005 | <0.005 |
| W | <0.005 | <0.005 | <0:005 | <0.005 | <0.005 |
| Zr | <0.005 | <0.005 | <0.005 | <0.005 | <0.005 |
| V | <0.05 | <0.05 | <0.05 | <0.05 | <0.05 |

TABLE 6-continued

Metals Analysis Results (PPM) Filter Pack Sampling ~2 m Above Arc Fault

| Metal | Blank (Avg) | Test 2 (Cu) | Test 3 (Cu) | Test 4 (Al) | Test 5 (Al) |
|---|---|---|---|---|---|
| Zn | 0.037 | 1.22 | 3.02 | 0.054 | 0.042 |
| Hg | <0.005 | <0.005 | <0.005 | <0.005 | <0.005 |
| U | <0.005 | <0.005 | <0.005 | <0.005 | <0.005 |

TABLE 7

Metals Analysis Results (PPM) from Acid Impinger Sampler Train

| Metal | MDL | Test 1 (Cu) | Test 2 (Cu) | Test 3 (Cu) | Test 4 (Al) | Test 5 (Al) |
|---|---|---|---|---|---|---|
| Al | <0.01 | 0.145 | 0.272 | 0.330 | 0.328 | 0.640 |
| Ca | <0.01 | 0.485 | 1.30 | 0.388 | 0.523 | 0.094 |
| Cu | <0.01 | 0.22 | 0.918 | 0.816 | 0.66 | 0.062 |
| Fe | <0.005 | 0.02 | 0.056 | 0.023 | 0.028 | 0.025 |
| K | <0.01 | 1.24 | 0.896 | 0.644 | 77.8 | 13000 |
| Mg | <0.002 | 0.042 | 0.134 | 0.056 | 0.318 | 0.012 |
| Na | <0.05 | 0.951 | 0.727 | 1.78 | 0.905 | 10.5 |
| P | <0.02 | <0.02 | 0.049 | <0.02 | <0.02 | <0.02 |
| S | <0.05 | 0.043 | 0.070 | 0.099 | 0.043 | 0.504 |
| Si | <0.1 | 0.303 | 0.48 | 1.10 | 0.49 | 21.4 |
| Ag | <0.0001 | 0.004 | 0.005 | 0.004 | 0.005 | 0.002 |
| As | <0.001 | <0.001 | <0.001 | <0.001 | <0.001 | <0.001 |
| B | <0.025 | 0.853 | 0.638 | 1.61 | 0.922 | 2.88 |
| Ba | <0.0001 | 0.006 | 0.008 | 0.007 | 0.006 | 0.002 |
| Bi | <0.001 | <0.001 | <0.001 | <0.001 | <0.001 | <0.001 |
| Be | <0.001 | <0.001 | <0.001 | <0.001 | <0.001 | <0.001 |
| Cd | <0.0001 | <0.0001 | <0.0001 | <0.0001 | 0.0002 | <0.0001 |
| Co | <0.0001 | 0.0001 | 0.0004 | <0.0001 | 0.0002 | 0.0001 |
| Cr | <0.0001 | 0.0007 | 0.0009 | 0.0006 | 0.0006 | 0.019 |
| Cs | <0.0001 | <0.0001 | <0.0001 | <0.0001 | 0.002 | 0.819 |
| Li | <0.001 | <0.001 | <0.001 | <0.001 | <0.001 | 0.004 |
| Mn | <0.0001 | 0.001 | 0.002 | 0.0006 | 0.0010 | 0.015 |

TABLE 7-continued

Metals Analysis Results (PPM) from Acid Impinger Sampler Train

| Metal | MDL | Test 1 (Cu) | Test 2 (Cu) | Test 3 (Cu) | Test 4 (Al) | Test 5 (Al) |
|---|---|---|---|---|---|---|
| Mo | <0.0001 | 0.0002 | 0.0002 | 0.0003 | 0.0002 | 0.0020 |
| Ni | <0.0001 | 0.002 | 0.001 | 0.002 | 0.002 | 0.001 |
| Pb | <0.0001 | 0.003 | 0.003 | 0.008 | 0.009 | 0.008 |
| Sb | <0.001 | 0.002 | 0.002 | 0.007 | 0.003 | <0.001 |
| Se | <0.001 | <0.001 | <0.001 | <0.001 | <0.001 | 0.004 |
| Sn | <0.0001 | 0.0004 | 0.0003 | 0.0002 | 0.0005 | 0.0020 |
| Sr | <0.0001 | 0.002 | 0.005 | 0.002 | 0.003 | 0.001 |
| Th | <0.0001 | <0.0001 | <0.0001 | <0.0001 | <0.0001 | <0.0001 |
| Ti | <0.0001 | 0.001 | 0.004 | 0.002 | 0.002 | 0.014 |
| Tl | <0.0001 | <0.0001 | <0.0001 | <0.0001 | <0.0001 | <0.0001 |
| W | <0.0001 | <0.0001 | <0.0001 | <0.0001 | 0.0001 | 0.037 |
| Zr | <0.0001 | 0.0002 | 0.0008 | 0.0007 | 0.0007 | 0.027 |
| V | <0.0001 | <0.0001 | <0.0001 | <0.0001 | <0.0001 | 0.0002 |
| Zn | <0.0001 | 0.01 | 0.009 | 0.01 | 0.021 | 0.003 |
| Hg | <0.0001 | <0.0001 | <0.0001 | <0.0001 | <0.0001 | <0.0001 |
| U | <0.0001 | <0.0001 | <0.0001 | <0.0001 | <0.0001 | <0.0001 |

A 2-liter air sample was taken through a filter pack at about 2 meters above each arc test. Each available exposed filter was analyzed for metals and other elements. The results for 38 element analyses are presented in Table 6.

Some key observations are noted from filter analysis for the Test-2 through Test-5 data available in Table 6: A key result noted is the below detection of aluminum for Test 5 compared to a measurable detection in Test 4. Both tests used new aluminum cables for the arc fault but in the Test 5 case the fault zone was encapsulated in FIREICE® prior to arc fault generation whereas for Test 4 the arc fault was initiated into air and then FIREICE® was added to quench the arc fault. The lead (Pb), antimony (Sb), magnesium (Mg), copper (Cu), and calcium (Ca) results add confirmation to the reduction of released metals with the arc fault encapsulated.

The counter ion for FIREICE® is potassium (K). For all four arc fault tests, the filter analysis did not detect potassium above the nominal background concentration of potassium present on the filter prior to exposure. This is evidence that FIREICE® did not undergo detectable degradation during the arc faults where FIREICE® was applied.

Test 2 and Test 3 were essentially duplicate tests using new neoprene jacketed copper cables for the arc fault with Test 3 having the more sustained arc fault. The procedure for applying FIREICE® was the same for both tests. At the on-set of the arc fault the addition of FIREICE® was begun and continued until the concrete cell was about ½ full. For the more sustained arc fault (Test 3) the key metals from the vaporized copper cable as measured with the filter pack were about 3 to 4 times higher than the metals released in the much shorter arc period of Test 2. Key metals released were aluminum (1.7%), copper (80%), magnesium (4.8%), zinc (0.8%), lead (1.2%), calcium (1.3%) and antimony (1.3%) with remaining components at <1% to only present at trace levels.

The estimated airborne total metals concentration for Test 3 is 0.17 g/m$^3$ and for Test 2 is 0.058 g/m$^3$. Similarly for the aluminum cables the estimated airborne total metals concentration for Test 4 is 0.003 g/m$^3$ and for Test 5 is 0.001 g/m$^3$.

For comparison the Ontario Ministry of Labor time-weighted average exposure concentration (TWAEC) for a variety of fumes and particulate, ranges from 0.003 to 0.01 g/m$^3$ for 40-hr work week and for short term exposures, the particulate concentrations range from 0.005 to 0.02 g/m$^3$ for a maximum 15 minute continuous exposure depending on the fume and particulate present.

Observations from the metals train analysis for Tests 1 through 5 are summarized below and are based on the metal/element analysis data present in Table 7.

The high level of potassium in the Test 5 results were from the entrainment of airborne FIREICE® into the first impinger as the arc generated gas that ejected some of the FIREICE® material into the air. This is confirmed by the increase in silica, sodium and sulfur.

For Test 4 a significant level of copper (0.66 ppm) is measured as copper residue from Tests 1 to 3 is released during the aluminum cable arc fault. However in Test 5 very little copper is detected (>10× less detected 0.062 ppm) with the FIREICE® encapsulating the arc fault zone. This also confirmed by the similar reduction in magnesium detected.

The impinger samples collected similar amounts of metals for the copper cable arc fault tests. The metal concentration levels were and are given in Table 7.

The application of FIREICE® to neoprene jacketed copper and aluminum cables is effective in reducing airborne organic compounds and also airborne metals. Removal efficiencies from 2 times to greater than 15 times can be expected when added to an active arc fault. For a FIREICE® encapsulated arc fault greater than 60 times removal of metals and arc generated arc products is possible based on the five tests performed. The optimum admixture is ratio of 100 grams of FIREICE® to 2.5 gallons of clean clear water.

The method for extinguishing and suppressing an electrical fire within a wooden electrical conduit comprising obtaining a source of pressurized fire extinguishing composition 112, securing a first end 114 of a flexible hose 24 to the pressurized fire extinguishing composition 112. A second end 22 of the flexible hose 24 is secured to the fluid dispenser 10 coupling element 12, the fluid dispenser having a body element 14 fluidly attached to the coupling element 12 formed from a tubular wall having a plurality of fluid passage apertures 22, and a leading element 16 attached to the body element 14. The fluid dispenser 10 is drawn through a wooden conduit 110 wherein pressurized fire extinguishing composition 112 is dispersed through the fluid passage apertures 22 for coating the interior surface of the conduit 110 with a fire extinguishing composition for fire extinguishing and reduction of airborne organic compounds and also airborne metals. The fluid dispenser 10 is drawn through the wooden conduit 110 by attaching a fish line 116 to the leading element 16. The fish line, also referred to as a snake line is commonly used for pulling wires through the conduit. It should be noted that the treatment of the conduit is best performed when the conduit is clear of wires. For this reason, an electrical wire that is to be discarded may be attached to the leading element 16 and the opposite end of the wire used to draw the fluid dispenser through the conduit. This method includes a preferred embodiment wherein the fire s extinguishing composition is formed from mixing a super absorbent polymer with water in an amount sufficient to form a non-conductive fluid. The liquid fire extinguishing composition is formed from a superabsorbent polymer such as the polymer marketed under the trademark FIREICE® and mixed with a judicious amount of water to create a non-conductive fluid capable of entrapping gases.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An apparatus for extinguishing and suppressing an electrical fire within a conduit comprising:

a source of pressurized fire extinguishing composition;

a flexible hose having a first end securable to said source of pressurized fire extinguishing composition and a second end;

a fluid dispenser having a coupling element securable to said second end of said flexible hose, a body element fluidly attached to said coupling element formed from a tubular wall having an inner wall surface forming a cavity and an outer wall surface with a plurality of directionally formed fluid passage apertures extending from the cavity through the outer wall surface causing rotation of said body by passage of pressurized fire extinguishing composition through said aperture, and a leading element attached to said body element and available for securement to a draw line for pulling said fluid dispenser and flexible hose through a conduit, said leading element having angular ridges to cause rotation when drawn through a conduit;

wherein a pressurized fire extinguishing composition is introduced in said flexible hose for delivery into said body element for dispersion through said fluid passage apertures for coating an interior surface of the conduit with fire extinguishing composition while the fluid dispenser is being drawn through the conduit.

2. The apparatus for extinguishing and suppressing an electrical fire within a conduit according to claim 1, wherein said leading element includes a fastener for securement to the draw line.

3. The apparatus for extinguishing and suppressing an electrical fire within a conduit according to claim 2, wherein said fastener is rotatable.

4. The apparatus for extinguishing and suppressing an electrical fire within a conduit according to claim 1, wherein said flexible hose is a conventional garden hose.

5. The apparatus for extinguishing and suppressing an electrical fire within a conduit according to claim 1, wherein coupling member is rotatable and includes a female fastener securable to a conventional male end of a garden hose.

6. The apparatus for extinguishing and suppressing an electrical fire within a conduit according to claim 1, wherein the conduit is constructed from wood.

7. The apparatus for extinguishing and suppressing an electrical fire within a conduit according to claim 1, wherein the fire extinguishing composition is a non-conductive liquid.

8. The apparatus for extinguishing and suppressing an electrical fire within a conduit according to claim 7, wherein said non-conductive liquid is an admixture of super absorbent polymer and water.

9. The apparatus for suppressing an electrical fire within a conduit according to claim 1 wherein said fire suppressant is marketed under the trademark FIREICE®.

10. An apparatus for extinguishing and suppressing an electrical fire within a conduit comprising:

a source of pressurized fire extinguishing composition;

a flexible hose having a first end securable to said source of pressurized fire extinguishing composition and a second end;

a fluid dispenser having a coupling element securable to said second end of said flexible hose, a body element fluidly attached to said coupling element formed from a tubular wall having an inner wall surface forming a cavity and an outer wall surface with a plurality of fluid passage apertures extending from the cavity through the outer wall surface including a cavity mounted impeller constructed and arranged to cause rotation of said body element by passage of the fire extinguishing composition through the apertures, and a leading element attached to said body element and available for securement to a draw line for pulling said fluid dispenser and flexible hose through a conduit, said leading element having angular ridges to cause rotation when drawn through a conduit;

wherein a pressurized fire extinguishing composition is introduced in said flexible hose for delivery into said body element for dispersion through said fluid passage apertures for coating an interior surface of the conduit with fire extinguishing composition while the fluid dispenser is being drawn through the conduit.

11. The apparatus for extinguishing and suppressing an electrical fire within a conduit according to claim 10, wherein said leading element includes a fastener for securement to the draw line.

12. The apparatus for extinguishing and suppressing an electrical fire within a conduit according to claim 11, wherein said fastener is rotatable.

13. The apparatus for extinguishing and suppressing an electrical fire within a conduit according to claim 10, wherein said flexible hose is a conventional garden hose.

14. The apparatus for extinguishing and suppressing an electrical fire within a conduit according to claim 10, wherein coupling member is rotatable and includes a female fastener securable to a conventional male end of a garden hose.

15. The apparatus for extinguishing and suppressing an electrical fire within a conduit according to claim 10, wherein the conduit is constructed from wood.

16. The apparatus for extinguishing and suppressing an electrical fire within a conduit according to claim 10, wherein the fire extinguishing composition is a non-conductive liquid.

17. The apparatus for extinguishing and suppressing an electrical fire within a conduit according to claim 16, wherein said non-conductive liquid is an admixture of super absorbent polymer and water.

* * * * *